United States Patent [19]

Thompson

[11] 4,334,793

[45] Jun. 15, 1982

[54] PORTABLE SKI WAX APPLICATOR

[75] Inventor: Arnold M. Thompson, Wheaton, Ill.

[73] Assignee: Gold Lode, Inc., Lisle, Ill.

[21] Appl. No.: 196,731

[22] PCT Filed: Mar. 16, 1979

[86] PCT No.: PCT/US79/00167

§ 371 Date: Mar. 27, 1980

§ 102(e) Date: Mar. 27, 1980

[87] PCT Pub. No.: W080/01879

PCT Pub. Date: Sep. 18, 1980

[51] Int. Cl.[3] ..... A63C 11/08

[52] U.S. Cl. ..... 401/1; 401/193; 280/809

[58] Field of Search ..... 401/1, 2, 264, 193; 280/809

[56] References Cited

U.S. PATENT DOCUMENTS

| | | | |
|---|---|---|---|
| 3,385,954 | 5/1968 | Rabinowitz et al. | 219/421 |
| 3,711,678 | 1/1973 | Kuus | 219/227 |
| 3,912,902 | 10/1975 | Herniter | 219/228 |
| 3,950,105 | 4/1976 | Moss et al. | 401/1 |
| 3,968,345 | 7/1976 | Kollmeder | 219/228 |
| 3,988,070 | 10/1976 | Tobler et al. | 401/2 |
| 4,065,214 | 12/1977 | Daum et al. | 401/2 |
| 4,118,130 | 10/1978 | Kasnbke et al. | 401/2 |
| 4,215,947 | 8/1980 | Sparling | 401/1 |

FOREIGN PATENT DOCUMENTS

| | | | |
|---|---|---|---|
| 262691 | 3/1913 | Fed. Rep. of Germany | 401/1 |
| 638570 | 11/1936 | Fed. Rep. of Germany | 401/1 |
| 960164 | 3/1957 | Fed. Rep. of Germany | 401/1 |
| 2524391 | 12/1975 | Fed. Rep. of Germany | 280/11.37 T |
| 2638548 | 1/1977 | Fed. Rep. of Germany | 280/11.37 T |
| 2549376 | 9/1977 | Fed. Rep. of Germany | 401/1 |
| 441358 | 8/1912 | France | 401/1 |
| 622148 | 6/1961 | Italy | 401/2 |
| 179792 | 3/1936 | Switzerland | 280/11.37 T |
| 247737 | 12/1947 | Switzerland | 401/1 |

*Primary Examiner*—William Pieprz

*Attorney, Agent, or Firm*—Trexler, Bushnell & Wolters, Ltd.

[57] ABSTRACT

A portable ski wax applicator includes a container having heat-conductive walls defining a wax receiving well and a removable cover rendering the container substantially splash-proof in normal use, the walls including a flat bottom wall and end wall extending obliquely from the bottom wall and having an orifice extending therethrough, a valve element extending through the orifice and projecting outwardly from the end wall, a spring resiliently urging the valve element outwardly to close the orifice, an electrical heating element for heating the walls and liquifying wax in the well, and a handle which is grasped for moving the applicator along a ski surface with the end wall generally parallel to the surface while pressing the outer end of the valve element against the surface to deposit liquid wax thereon, and then for moving the applicator along the surface with the bottom wall adjacent to and generally parallel to the surface for spreading the deposited wax on the surface.

7 Claims, 9 Drawing Figures

PORTABLE SKI WAX APPLICATOR

BACKGROUND OF THE INVENTION

This invention relates to a portable ski wax applicator of the type having a well in which solid wax is liquified or melted by means of a heating element, and having manually operable means for depositing liquid wax from the well onto a ski surface and spreading the wax on the surface.

Portable ski wax applicators of the foregoing type have been disclosed in prior U.S. Pat. Nos. 3,950,105; 3,968,345; 3,988,070; and 4,065,214. The prior applicators have one or more shortcomings, including no valve control over wax flow from the applicator, no drip control where a valve is employed to control wax flow, susceptibility to splashing of hot wax, absence of means for guiding the applicator in use, and others. U.S. Pat. No. 3,385,954 discloses an electrically-heated wax-melting tool for encaustic painting, which incorporates a valve element in the tip of a hot wax dispensing spout, but otherwise is not well-adapted for use as a ski wax applicator. U.S. Pat. No. 3,912,902 discloses a device for heating wax once applied, the device having means for guiding its movement along a ski, but the device is lacking in means for applying the wax.

SUMMARY OF THE INVENTION

An important object of the invention is to provide a portable ski wax applicator of the above-described type, which is non-splashing and incorporates valve control over liquid wax flow while eliminating dripping, to avoid in any way depositing hot wax on the user or adjacent objects, or in excess quantities on a ski surface being waxed.

Another object is to provide such an applicator constructed for metering quantities of liquid wax onto a ski surface and then spreading the wax on the surface, in separate and independent procedures. An accompanying object is to provide an applicator with which liquid wax is applied to the ski surface and then spread on the surface in a single back and forth operation, which is both easy and effective.

An additional object is to provide a small and compact applicator having the foregoing characteristics, which is convenient in use and readily packed and carried about. Other objects include the provision of an applicator which overcomes the above-described shortcomings of the prior art and provides advantages thereover.

The portable ski wax applicator in accordance with the invention includes a container having heat-conductive walls defining a wax-receiving well and a removable cover rendering the container substantially splash-proof in normal use, the walls including a flat bottom wall and an end wall extending obliquely from the bottom wall and having an orifice extending therethrough, valve means extending through the orifice and projecting outwardly from the end wall, spring means urging the valve means outwardly to close the orifice, whereby pressure exerted on the outer end of the valve means serves to meter liquid wax from the well through the orifice and to the exterior of the end wall, an electrical heating element mounted on the container for heating the walls and liquifying wax contained in the well when energized, and a handle connected to the container and adapted to be grasped manually for moving the applicator along a ski surface with the end wall generally parallel to the surface while pressing the outer end of the valve means against the surface to deposit liquid wax thereon, and then for moving the applicator along the surface with the bottom wall adjacent to and generally parallel to the surface for spreading the deposited wax on the surface.

BRIEF DESCRIPTION OF THE DRAWINGS

The drawing illustrate, without limitation thereto, a preferred embodiment of the invention, which accomplishes the foregoing and other objects, advantages, and functions. In the drawings, like parts are identified by like reference symbols in each of the views, and.

DESCRIPTION OF THE PREFERRED EMBODIMENT

Figure 1:
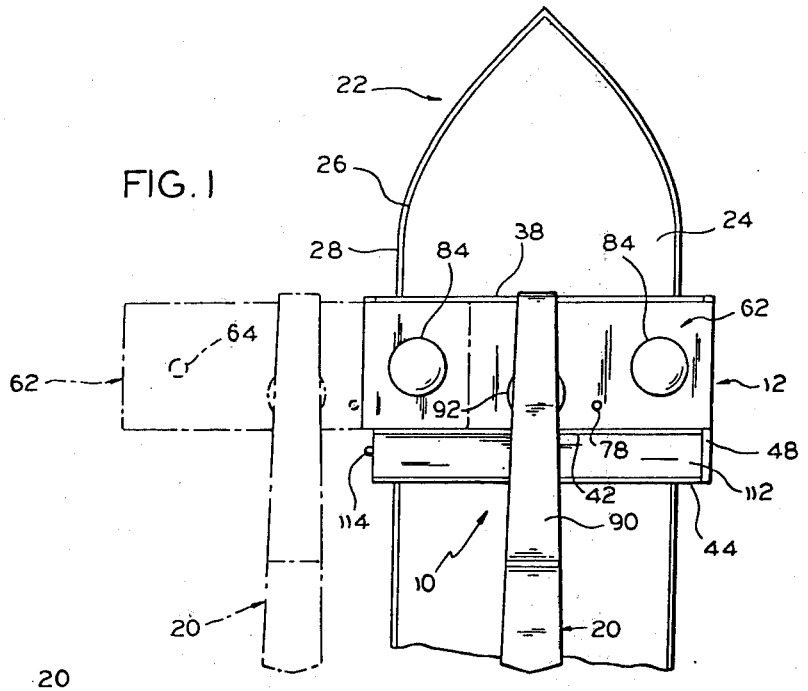
FIG. 1 is a top plan view of an applicator in accordance with the invention, illustrating the applicator in its relation to the bottom surface of a snow ski to be waxed, and also illustrating in phantom lines an alternative position of a cover and a handle of the applicator.
Figure 8:
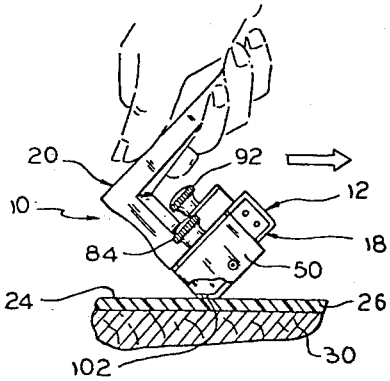
FIG. 8 is a view on a reduced scale of the applicator, having a part broken away, as it appears while being moved manually over the bottom surface of the ski, shown fragmentarily and in section, for the purpose of depositing liquid wax on the surface.
Figure 9:
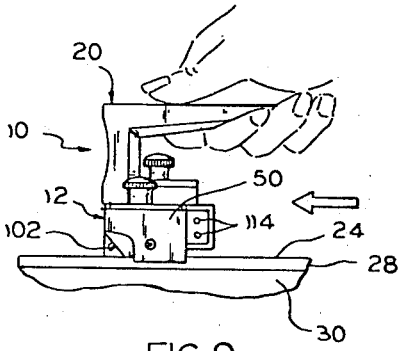
FIG. 9 is a view on a similar scale, with a part of the applicator broken away and the ski shown fragmentarily, illustrating the applicator being moved manually for the purpose of spreading the wax on the bottom surface of the ski.

Referring to the drawings, a portable ski wax applicator 10 constitutes a preferred embodiment of the invention. The applicator 10 includes a container 12 having mounted thereon valve means 14 (FIG. 7), spring means 16 (FIG. 6), an electrical resistance heating element 18 (FIG. 2), and a handle 20. One type of snow ski 22 with which the applicator 10 may be used is illustrated in FIGS. 1, 8 and 9. The illustrative ski 22 includes a bottom or running surface 24, which is formed by a relatively thick plastic layer 26 bounded by a metal runner 28. The layer 26 and the runner 28 are secured to a ski body 30, which in the illustrative embodiment is formed of wood.

Figure 7:
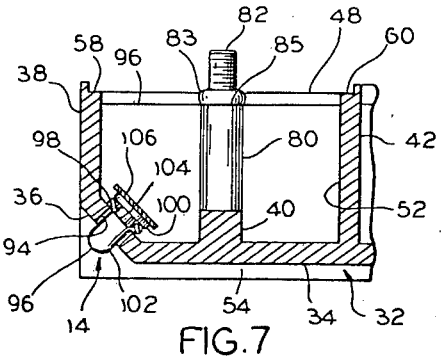
FIG. 7 is an enlarged fragmentary sectional view of the applicator, taken substantially on line 7—7 of FIG. 6.

The container 12 has a one-piece elongated body 32 (FIG. 7). The body 32 includes, as integral components thereof, a flat bottom wall 34, an oblique front end wall 36, an upright front end wall 38, a crossbar 40, an upright intermediate wall 42, and an upright rear end wall 44 (FIG. 2), all of which extend transversely of the body. The oblique front end wall 36 extends upwardly and forwardly at a preferred angle of about 45° from the bottom wall 34, and the upright front end wall 38 extends upwardly from the outer end of the oblique front end wall 36. The crossbar 40 extends upwardly from the bottom wall 34, in spaced relation to the oblique front end wall 36 and to the intermediate wall 42. The intermediate wall 42 and the rear end wall 44 are spaced apart for receiving the heating element 18, of the ceramic type, therebetween.

Figure 2:
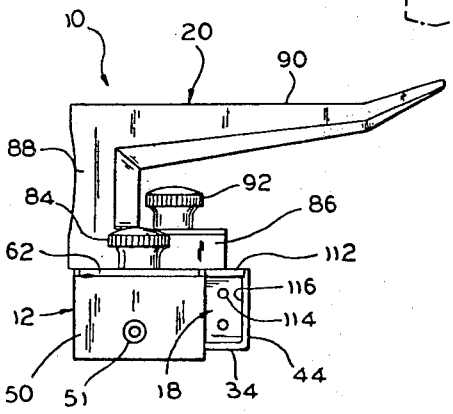
FIG. 2 is a side elevation of the applicator.

Inner side walls 46 (FIGS. 6 and 7) extend between the front end wall 38 and the intermediate wall 42 at opposite ends thereof. Outer side walls 48 and 50 (FIGS. 6 and 7) are secured to the body 32 adjacent to the inner side walls 46, as by screws 51 (FIG. 2). One outer side wall 48 extends from the front end wall 38 to the rear end wall 44, while the remaining outer side wall 50 extends from the front end wall 38 only to the intermediate wall 42. The outer side walls 48 and 50 include flanges or flange portions 54 and 56 (FIG. 3), respectively, which project below the lower surface of the bottom wall 34. The bottom wall 34, the oblique and upright front end walls 36 and 38, respectively, the intermediate wall 42, and the inner side walls 46 define a wax-receiving well or reservoir 52 within the container 12.

Figure 5:
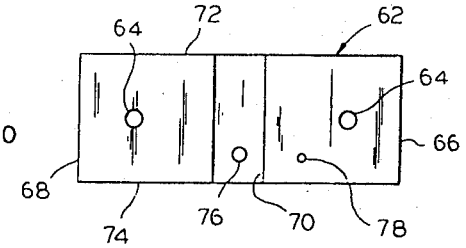
FIG. 5 is a top plan view of the cover of the applicator.

Recessed shoulders 58 and 60 (FIGS. 6 and 7) extend for the length of the upright front end and intermediate walls 38 and 42, respectively, at the upper level of the portions of the outer side walls 48 and 50 which extend between the former walls. A removable rectangular plate-like cover 62 (FIG. 5) seats on the shoulders 58 and 60, and on the upper edges of the outer side walls 48 and 50, to effectively cover and close the well 52. The cover 62 is provided with a pair of bolt holes 64 adjacent to and spaced from its opposite side margins 66 and 68. A handlereceiving depression 70 is formed in the outer surface of the cover 62, and it extends centrally between the front and rear margins 72 and 74, respectively, of the cover. A tapped bolt-engaging hole 76 is provided in the cover 62, centrally of the sides of the depression 70 and adjacent to the rear margin 74. A relatively small vent or breather hole 78 is formed in the cover 62 between one side margin 66 and the depression 70, and adjacent to the rear margin 74.

Figure 3:
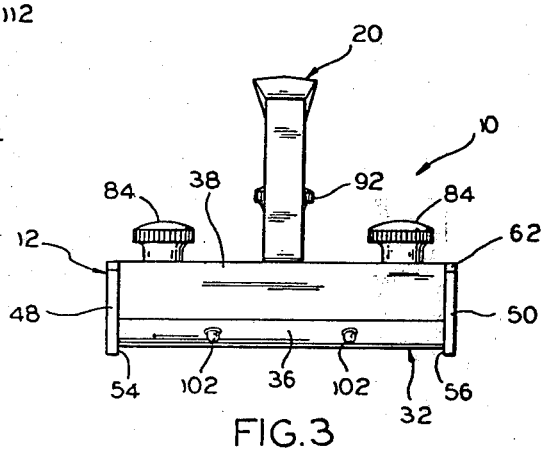
FIG. 3 is an end elevation of the applicator, as viewed from what is termed herein the front end of the applicator.
Figure 4:
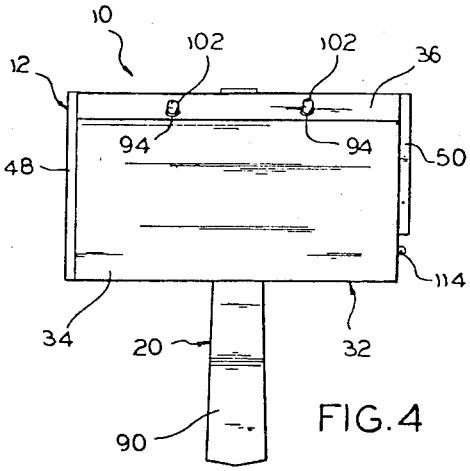
FIG. 4 is a bottom plan view of the applicator.
Figure 6:
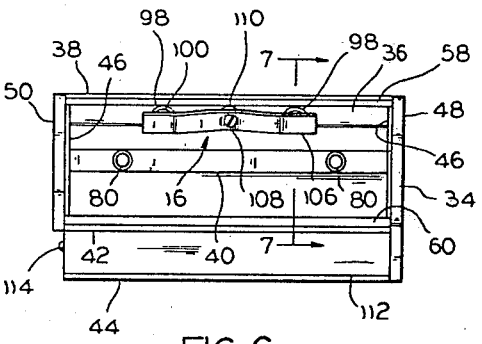
FIG. 6 is a top plan view of the applicator, with the cover and the handle removed.

Referring to FIGS. 6 and 7, two shouldered bolt members 80 having upwardly projecting reduced threaded ends 82 are secured to and extend upwardly from the crossbar 40, adjacent to and spaced from respective inner side walls 46. An O-ring gasket 83 is seated on the shoulder 85 of each bolt member 80, around its threaded end 82, and it projects slightly above the level of the wall shoulders 58 and 60. The threaded ends 82 extend through the bolt holes 64 when the cover 62 is in place on the container body 32. As seen in FIGS. 1–3, the cover 62 is secured in place by means of thumb nuts 84, which engage the threaded ends 82. The nuts 84 tighten against the outer surface of the cover 62 and hold it securely against the shoulders 58 and 60, the upper edges of the outer side walls 48 and 50, and the gaskets 83, serving to seal the bolt holes 64.

Referring to FIGS. 1–3 and 5, the handle 20 is constructed integrally of a lower mounting portion 86, an intermediate spacer portion 88, and an upper gripping portion 90. The mounting portion 86 is received in the depression 70 of the cover 62, with the gripping portion 90 extending rearwardly, in the direction of the rear margin 74. A thumb bolt 92 is inserted through the mounting portion 86 and into the tapped bolt-engaging hole 76, in threaded engagement with the cover 62 therein. In this manner, the handle 20 is directly connected to the cover 62, so that, with the thumb nuts 84 removed, the cover may be removed from the container body 32 by grasping the gripping portion 90 and moving the handle relative to the container body.

The foregoing description of the mounting of the cover 62 pertains to the position in which it closes the well 52 to prevent splashing out of the well of molten material contained therein. Alternatively, the cover 62 may be mounted in the position illustrated in phantom lines in FIG. 1. In this position, the threaded end 82 of but one bolt member 80 is inserted through a bolt hole 64 in the cover, and the cover is in an uncovering position with respect to the well 52, wherein the major portion of the cover extends outwardly to one side of the container body 32. Similarly, the cover 62 could be mounted so that it extends outwardly from the opposite side of the body 32. In each case, the applicator 10 may be manipulated by means of the handle 20.

Referring to FIGS. 6 and 7, the oblique front end wall 36 is provided with two discharge orifices 94 extending perpendicularly therethrough. The orifices 94 are spaced along the wall 36 on opposite sides of the center of the wall and a substantial distance from each other, and they also are spaced from the outer side walls 48 and 50.

Each valve means 14 includes a valve element or valve proper 96 and an O-ring gasket or seal 98. The valve element 96 includes a flat circular disk-like head portion 100, and a round-nosed generally cylindrical shank portion 102 of reduced diameter extending perpendicularly therefrom. An annular groove 104 is provided on the shank portion 102 adjacent to the head portion 100, and it receives and holds in place the gasket 98. The shank portion 102 extends through an orifice 94 from the well 52 and projects outwardly from the oblique front end wall 36. The shank portion 102 is of smaller diameter than the orifice 94, fitting loosely therein, thereby to provide clearance between the shank portion and the wall of the orifice, which serves to permit discharge of a liquid from the well 52 through the orifice and to the exterior of the end wall 36.

The spring means 16 includes a generally flat elongated spring element 106, a screw 108, and an O-ring gasket 110. The opposite ends of the spring element 106 engage the outer surfaces of the head portions 100 of the respective valve elements 96. The screw 108 is inserted through a corresponding opening in the center of the spring element 106, through the gasket 110, and into the oblique front end 36 in threaded engagement therewith, to cause the ends of the spring element to bear against the valve elements 96 with spring pressure. The spring element 106 thus resiliently urges the valve elements 96 outwardly and against the respective gaskets 98 of the valve means to compress the same and thereby close the orifices 94. Pressure exerted on the rounded outer ends of the valve elements 96 will cause the elements to move inwardly, into the well 52, carrying the gaskets 98 therewith, thereby to open the orifices 94 for metering liquid material from the well through the orifices. The rate of discharge from the orifices increases with increasing pressure on the ends of the valve elements 96 and correspondingly increasing inward movement of the valve elements.

Referring to FIGS. 1 and 2, a closure 112 in the form of a strip of rigid material extends between the intermediate and rear end walls 42 and 44 over the heating element 18. The heating element is recessed from the side edges of such walls and closure, and from the bottom wall 34, on one side of the container 12, i.e., the side on which the outer side wall 50 is mounted. Two spaced apart prongs 114 extend outwardly from the body of the heating element 18, with their major portions enclosed by the foregoing walls and closure. The structure thus forms a void 116 for reception of a female electrical plug therein, in engagement with the prongs 114. Such a plug, not shown, may be connected to an electrical cord, which terminates at its opposite end in a plug suitable for engagement in an electrical receptacle as a source of electrical energy. The cord then will extend outwardly from one side of the applicator 10 in use.

The container body 32, the inner side walls 46, and the cover 62 are constructed of suitable heat-conductive material, which may be, for example, a lightweight and durable metal such as an aluminum alloy. The outer side walls 48 and 50, the closure 112, the handle 20, and the finger-engaging portions of the thumb nuts 84 and the thumb bolt 92 are constructed of material having relatively low heat conductivity, such as a suitable heat-resistant synthetic resin or other heat-insulating material.

In use, and with the cover 62 removed from the container body 32 and the handle 20 attached to the cover, solid ski wax, which may be in the form of a block or chunks, is placed in the well 52. An electrical cord having plugs at its ends is connected to the heating element 18, which may be thermostatically controlled, and to a source of electrical energy, such as a standard 110–120 volt AC receptacle. When the wax is liquefied or melted, usually requiring approximately 5 minutes, the liquid level in the well 52 is checked, and more wax is added and melted if desired.

Using the handle 20, the cover is placed on the container body 32 and secured thereto by the thumb nuts 84, as illustrated in FIGS. 1–3. Grasping the gripping portion 90 of the handle 20 in one hand, and with the ski 22 supported with its bottom surface 24 facing upwardly and substantially horizontal, the waxing procedure is commenced, preferably at the tip of the ski. The applicator 10 is tilted about 45°, so that the oblique end wall 36 is generally parallel to the ski surface 24, as illustrated in FIG. 8, and the outer ends of the valve elements 96 are pressed against the ski surface. At the same time, the applicator is moved manually towards the rear of the ski, for the complete length thereof. The pressure on the valve elements 96 and the speed of movement of the applicator along the ski determine the quantity of liquid wax deposited on the surface 24. Two lines of liquid wax are deposited, one on each side of the center of the ski. When the rear end of the ski is reached, the applicator is placed in a generally horizontal position, with its bottom wall 34 on the ski surface 24 and parallel thereto. The applicator then is moved manually in the opposite direction, from the rear end to the front end of the ski, for spreading the deposited wax on the ski surface, as illustrated in FIG. 9.

In each movement of the applicator 10, the flange portions 54 and 56 of the respective outer side walls 48 and 50 are disposed outwardly of the side edges of the ski, and they extend below the bottom surface 24 of the ski, to guide the applicator in its movement. The applicator thereby is held on the ski 22, and its bottom wall 34 at all times extends completely across the ski surface 24. The entire procedure may be completed rapidly and without shifting the hand on the applicator. The waxing procedure may be repeated if more wax is desired on the ski surface 24. During the procedure, the electrical cord will drop to the side of the ski, out of contact with the ski surface 24.

While the foregoing sequence of movements is preferred, it will be apparent that the applicator 10 may be moved in either direction along the ski 22 for depositing liquid wax on its surface 24 or for spreading the deposited wax thereon, as desired. In any event, lines of wax are deposited on opposite sides of the center of the ski, thus accommodating grooved as well as ungrooved bottom surfaces.

In order to remove the cover 62, the thumb nuts 84 are removed, and the cover is lifted by the handle 20. Should it be desired to remove the liquid wax from the well 52, for changing the wax or for another reason, the right-hand bolt hole 64 may be placed over the left-hand bolt member 80, and the cover is secured to the bolt member by a thumb nut 84, as illustrated in FIG. 1. The handle then may be manipulated to pour the wax out of the well.

Employing the applicator 10 properly, there is no dripping or splashing of hot wax onto the ski or other surfaces. The applicator is lightweight and compact, having dimensions for the assembled container body 32 and cover 62 of approximately $4\frac{1}{4}''$ in width, $2\frac{1}{4}''$ in depth, from front to rear, and $1\frac{1}{8}''$ in height in the illustrative embodiment.

While a preferred embodiment of the invention has been described and illustrated, it will be apparent to those skilled in the art that various changes and modifications may be made therein within the spirit and scope of the invention. It is intended that such changes and modifications be included within the scope of the appended claims.

I claim:

1. A portable ski wax applicator which comprises: a container having heat-conductive walls defining a wax-receiving well and a removable cover rendering the container substantially splash-proof in normal use, said walls including a flat bottom wall and an end wall extending obliquely from said bottom wall and having an orifice extending therethrough, valve means extending through said orifice and projecting outwardly from said end wall, spring means resiliently urging said valve means outwardly to close said orifice, whereby pressure exerted on the outer end of said valve means serves to meter liquid wax from said well through said orifice and to the exterior of said end wall, an electrical heating element mounted on said container for heating the walls and liquefying wax contained in said well when energized, a handle adapted to be grasped manually for moving the applicator along a ski surface with said end wall generally parallel to the surface while pressing the outer end of said valve means against the surface to deposit liquid wax thereon, and then for moving the applicator along the surface with said bottom wall adjacent to and generally parallel to the surface for spreading the deposited wax on the surface, means for connecting said handle directly to said cover, whereby the cover may be removed by grasping and moving the handle relative to said walls, and means for removably connecting said cover to said walls alternatively in covering and uncovering positions with respect to said well.

2. An applicator as defined in claim 1 and including flanges on opposite sides of said container and projecting below the lower surface of said bottom wall and below said ski surface on opposite sides of the ski for guiding the applicator during said movements thereof.

3. An applicator as defined in claim 2 and wherein said heating element is adapted for the connection of an electrical cord thereto at one of said container sides, whereby the cord will drop to the side of the ski out of contact with said ski surface in use.

4. An applicator as defined in claim 1 and wherein said valve means includes a pair of valve elements extending into said well, and said spring means includes an elongated spring element mounted in said well and engaging an inner portion of each valve element.

5. A portable ski wax applicator which comprises: a container having heat-conductive walls defining a wax-receiving wall and a removable cover rendering the container substantially splash-proof in normal use, said walls including a flat bottom wall, an end wall extending obliquely forwardly from said bottom wall and having a pair of transversely spaced apart orifices extending therethrough, and a rearwardly disposed wall extending upwardly from said bottom wall in spaced relation to said end wall, valve means including a pair of valve elements extending through said orifices from said well and projecting outwardly from said end wall, spring means mounted in said well and resiliently urging said valve elements outwardly to close said orifices, whereby pressure exerted on the outer ends of said valve elements serves to meter liquid wax from said well through said orifices and to the exterior of said end wall, an electrical heating element mounted on said container along said rearwardly disposed wall for heating the walls and liquefying wax contained in said well when energized, a handle adapted to be grasped manually for moving the applicator along a ski surface in one direction with said end wall generally parallel to the surface while pressing the outer end of said valve means against the surface to deposit liquid wax thereon, and then for moving the applicator along the surface in the opposite direction with said bottom wall adjacent to and generally parallel to the surface for spreading the deposited wax on the surface, said handle being connected directly to said cover, whereby the cover may be removed by grasping and moving the handle relative to said walls, flanges on opposite sides of said container and projecting below the lower surface of said bottom wall and below said ski surface on opposite sides of the ski for guiding the applicator during said movements thereof, and means for removably connecting said cover to said walls alternatively in covering and uncovering positions with respect to said well, said connecting means including heat-insulated thumb nuts.

6. An applicator as defined in claim 5 and wherein said heating element is adapted for the connection of an electrical cord thereto at one of said container sides, whereby the cord will drop to the side of the ski out of contact with said ski surface in use.

7. An applicator as defined in claim 5 and wherein said spring means includes an elongated spring element engaging an inner portion of each valve element.

* * * * *

UNITED STATES PATENT AND TRADEMARK OFFICE

CERTIFICATE OF CORRECTION

PATENT NO. : 4,334,793

DATED : June 15, 1982

INVENTOR(S) : ARNOLD M. THOMPSON

It is certified that error appears in the above-identified patent and that said Letters Patent is hereby corrected as shown below:

Column 6, line 22, "2 1/4"" should be --2 1/8--;

Column 7, line 11, "wall" should be --well--.

Signed and Sealed this

*Twelfth* Day of *October 1982*

[SEAL]

*Attest:*

GERALD J. MOSSINGHOFF

*Attesting Officer*

*Commissioner of Patents and Trademarks*